US009227293B2

(12) United States Patent
David et al.

(10) Patent No.: US 9,227,293 B2
(45) Date of Patent: Jan. 5, 2016

(54) MULTI-PLATEN MULTI-HEAD POLISHING ARCHITECTURE

(71) Applicant: Applied Materials, Inc., Santa Clara, CA (US)

(72) Inventors: Jeffrey Drue David, San Jose, CA (US); Boguslaw A. Swedek, Cupertino, CA (US); Doyle E. Bennett, Santa Clara, CA (US); Thomas H. Osterheld, Mountain View, CA (US); Benjamin Cherian, San Jose, CA (US); Dominic J. Benvegnu, La Honda, CA (US); Harry Q. Lee, Los Altos, CA (US); Allen L. D'Ambra, Burlingame, CA (US); Jagan Rangarajan, Fremont, CA (US)

(73) Assignee: Applied Materials, Inc., Santa Clara, CA (US)

( * ) Notice: Subject to any disclaimer, the term of this patent is extended or adjusted under 35 U.S.C. 154(b) by 123 days.

(21) Appl. No.: 13/791,617

(22) Filed: Mar. 8, 2013

(65) Prior Publication Data

US 2014/0141695 A1 May 22, 2014

Related U.S. Application Data

(60) Provisional application No. 61/729,195, filed on Nov. 21, 2012.

(51) Int. Cl.

| | |
|---|---|
| ***B24B 37/00*** | (2012.01) |
| ***B24B 37/005*** | (2012.01) |
| ***B24B 37/013*** | (2012.01) |

(Continued)

(52) U.S. Cl.

CPC ..... *B24B 37/005* (2013.01); *B24B 37/013* (2013.01); *B24B 37/04* (2013.01); *B24B 37/345* (2013.01)

(58) Field of Classification Search

CPC .... B24B 37/005; B24B 37/013; B24B 37/04; B24B 37/345; B24B 41/005; B24B 45/003; B24B 49/03; B24B 49/12

USPC ..... 451/5, 6, 8, 11, 41, 285–290

See application file for complete search history.

(56) References Cited

U.S. PATENT DOCUMENTS

| | | | | |
|---|---|---|---|---|
| 5,738,574 | A | 4/1998 | Tolles et al. | |
| 5,816,891 | A * | 10/1998 | Woo | 451/6 |
| 7,195,535 | B1 * | 3/2007 | Swedek et al. | 451/5 |

(Continued)

OTHER PUBLICATIONS

International Search Report and Written Opinion in International Application No. PCT/US2013/069736, dated Feb. 26, 2014, 14 pages.

(Continued)

*Primary Examiner* — Maurina Rachuba

(74) *Attorney, Agent, or Firm* — Fish & Richardson P.C.

(57) ABSTRACT

A polishing apparatus includes a plurality of stations supported on a platform, the plurality of stations including at least two polishing stations and a transfer station, each polishing station including a platen to support a polishing pad, a plurality of carrier heads suspended from and movable along a track such that each polishing station is selectively positionable at the stations, and a controller configured to control motion of the carrier heads along the track such that during polishing at each polishing station only a single carrier head is positioned in the polishing station.

19 Claims, 8 Drawing Sheets

(51) Int. Cl.
*B24B 37/04* (2012.01)
*B24B 37/34* (2012.01)

(56) References Cited

U.S. PATENT DOCUMENTS

| | | | | |
|---|---|---|---|---|
| 7,198,548 | B1 * | 4/2007 | Chen | 451/11 |
| 7,764,377 | B2 | 7/2010 | Benvegnu et al. | |
| 2003/0054648 | A1 | 3/2003 | Jeong | |
| 2005/0227586 | A1 | 10/2005 | Jeong | |
| 2007/0077861 | A1 * | 4/2007 | Chen | 451/5 |
| 2009/0258574 | A1 * | 10/2009 | Yilmaz et al. | 451/28 |
| 2010/0035526 | A1 | 2/2010 | Tolles et al. | |
| 2010/0217430 | A1 | 8/2010 | David et al. | |
| 2011/0256805 | A1 | 10/2011 | David et al. | |
| 2011/0300776 | A1 | 12/2011 | Mai et al. | |
| 2014/0141696 | A1 * | 5/2014 | David et al. | 451/11 |

OTHER PUBLICATIONS

U.S. Appl. No. 13/773,063, filed Feb. 21, 2013, David et al.
U.S. Appl. No. 13/454,002, filed Apr. 23, 2012, Bevegnu et al.

* cited by examiner

MULTI-PLATEN MULTI-HEAD POLISHING ARCHITECTURE

CROSS-REFERENCE TO RELATED APPLICATIONS

This application claims priority to U.S. Provisional Application Ser. No. 61/729,195, filed Nov. 21, 2012, the entire disclosure of which is incorporated by reference.

TECHNICAL FIELD

This disclosure relates to the architecture of a chemical mechanical polishing (CMP) system and to metrology in a CMP system.

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the metallic layer remaining between the raised pattern of the insulative layer form vias, plugs, and lines that provide conductive paths between thin film circuits on the substrate. For other applications, such as oxide polishing, the filler layer is planarized until a predetermined thickness is left over the non planar surface. In addition, planarization of the substrate surface is usually required for photolithography.

Chemical mechanical polishing (CMP) is one accepted method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. An abrasive polishing slurry is typically supplied to the surface of the polishing pad.

Variations in the slurry distribution, the polishing pad condition, the relative speed between the polishing pad and the substrate, and the load on the substrate can cause variations in the material removal rate. These variations, as well as variations in the initial thickness of the substrate layer, cause variations in the time needed to reach the polishing endpoint. Therefore, determining the polishing endpoint merely as a function of polishing time can lead to overpolishing or underpolishing of the substrate. Various in-situ monitoring techniques, such as optical or eddy current monitoring, can be used to detect a polishing endpoint.

SUMMARY

In some systems, a substrate is polished at a sequence of polishing stations. Some systems polish multiple substrates simultaneously on a single polishing pad in the polishing station. However, coordinating endpoint control and cross-contamination can be problems. An interesting architecture that is adaptable to many different polishing situations includes four platens, with one substrate being polished per platen.

In some systems, the substrate is monitored in-situ during polishing, e.g., by optically or eddy current techniques. However, existing monitoring techniques may not reliably halt polishing at the desired point. A spectrum from the substrate can be measured by an in-sequence metrology station. That is, the spectrum can be measured while the substrate is still held by the carrier head, but at a metrology station positioned between the polishing stations. A value can be calculated from the spectrum which can be used in controlling a polishing operation at one or more of the polishing stations.

In one aspect, a polishing apparatus includes N polishing stations, an even number of carrier heads held by a support structure and movable to the N polishing stations in sequence, a transfer station, and a controller. N is an even number equal to or greater than 4. Each polishing station including a platen to support a polishing pad. The controller is configured to cause two substrates to be loaded into two of the carrier heads in the transfer station, move the two of the carrier heads to a first pair of the N polishing stations, simultaneously polish the two substrates in a first polishing step at the first pair of the N polishing stations, move the two of the carrier heads to a second pair of the N polishing stations, simultaneously polish the two substrates in a second polishing step at the second pair of the N polishing stations, move the two of the carrier heads to the transfer station, and cause the two substrates to be unloaded from the two of the carrier heads.

Implementations may include one or more of the following features. The number of carrier heads may equal N or N+2. N may be 4. The transfer station may include two load cups. The controller may be configured to cause a first substrate of the two substrates to be loaded at a first load cup of the two load cups, moved past a first polishing station of the first pair to a second polishing station of the first pair, polished at the second polishing station of the first pair, moved past a first polishing station of the second pair to a second polishing station of the second pair, and polished at the second polishing station of the first pair. The polishing stations and transfer station may be supported on a platform and positioned at substantially equal angular intervals around a center of the platform. The controller may be configured operate in one of a plurality of modes. In a first mode of the plurality of modes the controller may cause the two of the carrier heads to move to the first pair of the N polishing stations. In a second mode of the plurality of modes the controller may cause a carrier head to move sequentially to each of the N polishing stations and cause the substrate to be polished at each of the N polishing stations.

The apparatus may include two in-sequence metrology stations. A first probe of the two in-sequence metrology stations may be positioned between a first station and a second station of the second pair of polishing stations and a second probe of the two in-sequence metrology stations may be positioned between the second station and the transfer station. A first probe of the two in-sequence metrology stations may be positioned between a first station of the first pair of polishing stations and the transfer station and a second probe of the two in-sequence metrology stations may be positioned between the first station and a second station of the first pair of polishing stations.

In another aspect, a polishing apparatus includes five stations supported on a platform and positioned at substantially equal angular intervals around a center of the platform, and a plurality of carrier heads suspended from and movable along a track such that each polishing station is selectively positionable at the stations. The five stations including four polishing stations and a transfer station, each polishing station including a platen to support a polishing pad.

In another aspect, a polishing apparatus includes a plurality of stations supported on a platform, the plurality of stations including at least two polishing stations and a transfer station, each polishing station including a platen to support a polishing pad, a plurality of carrier heads suspended from and movable along a track such that each polishing station is selectively positionable at the stations, and a controller configured to control motion of the carrier heads along the track such that during polishing at each polishing station only a single carrier head is positioned in the polishing station.

Implementations may include one or more of the following features. The controller may be configured to operate in one of a plurality of modes. In a first mode of the plurality of modes the controller may be configured to cause two substrates to be loaded into two of the carrier heads in the transfer station, move the two of the carrier heads to a first pair of the plurality of polishing stations, and simultaneously polish the two substrates in a first polishing step at the first pair of the polishing stations. In the first mode the controller may be configured to move the two of the carrier heads to a second pair of the plurality of polishing stations, simultaneously polish the two substrates in a second polishing step at the second pair of the plurality of polishing stations, move the two of the carrier heads to the transfer station, and cause the two substrates to be unloaded from the two of the carrier heads. In a second mode of the plurality of modes the controller may be configured to cause a carrier head to move sequentially to each of the plurality of polishing stations and cause the substrate to be polished at each of the polishing stations.

In another aspect, a polishing apparatus includes five stations supported on a platform and positioned at substantially equal angular intervals around a center of the platform, the five stations including three polishing stations, a transfer station and a metrology station, each polishing station including a platen to support a polishing pad, a plurality of carrier heads suspended from and movable along a track such that each polishing station is selectively positionable at the stations, and an in-sequence metrology system having a probe located in the metrology station.

Implementations may include one or more of the following features. The metrology station may include a single probe from the in-sequence metrology system. The metrology station may include a plurality of probes from a plurality of in-sequence metrology systems.

In another aspect, a polishing apparatus includes a plurality of polishing stations, each polishing station including a platen to support a polishing pad, a plurality of carrier heads held by a support structure and movable to the polishing stations in sequence, a transfer station including a plurality of load cups, and a plurality of in-sequence metrology systems, each metrology system of the plurality of metrology systems having a probe located in different load cup of the plurality of load cups.

In another aspect, a method of operating a polishing system includes transporting a substrate forward along a path past a polishing station to a probe of an in-sequence metrology system without polishing the substrate at the polishing station, measuring the substrate with the metrology system, transporting the substrate backward along the path to the polishing station; and polishing the substrate at the polishing station.

Implementations may include one or more of the following features. After polishing the substrate, the substrate may be transported forward along the path to another station. The another station may be another polishing station or a transfer station. Transporting the substrate along the path may include supporting a carrier head on a track and moving the carrier head along the track.

In another aspect, a method of controlling a polishing system includes transporting a substrate forward along a path past a probe of an in-sequence metrology system to a polishing station without measuring the substrate with the in-sequence metrology system, polishing the substrate at the polishing station, transporting the substrate backward along the path to the probe of the in-sequence metrology system, and measuring the substrate with the metrology system.

Implementations may include one or more of the following features. The substrate may be transported forward along the path past the polishing station to another station. The another station may be another polishing station or a transfer station. Transporting the substrate along the path may include supporting a carrier head on a track and moving the carrier head along the track.

Implementations can include one or more of the following potential advantages. The system be adaptable to the needs of many different polishing situations, and can provide high through-put for common two-step polishing recipes. Polishing endpoints can be determined more reliably, and within-wafer non-uniformity (WTWNU) and wafer-to-wafer non-uniformity (WTWNU) can be reduced.

The details of one or more implementations are set forth in the accompanying drawings and the description below. Other aspects, features and advantages will be apparent from the description and drawings, and from the claims.

DESCRIPTION OF DRAWINGS

Like reference symbols in the various drawings indicate like elements.

DETAILED DESCRIPTION

As integrated circuits continue to develop, line widths continue to shrink and layers in the integrated circuit continue to accumulate, requiring ever more stringent thickness control. Thus, polishing process control techniques, whether utilizing in-situ monitoring or run-to run process control, face challenges to maintain keep the post-polishing thickness within specification.

For example, when performing in-situ spectrographic monitoring of a multi-layer product substrate, an incident optical beam from the spectrographic monitoring system can penetrate a several dielectric layers before being reflected by metal lines. The reflected beam can thus be a result of the thickness and critical dimensions of multiple layers. A spectrum resulting from such a complex layer stack often presents a significant challenge in determining the thickness of the outermost layer that is being polishing. In addition, the outermost layer thickness is an indirect parameter for process control. This is because in many applications the metal line thickness—a parameter that may be more critical to yield—can vary even if the outermost layer thickness is on target, if other dimensions such as etch depth or critical dimension vary.

A control scheme for determining a polishing endpoint incorporates wet metrology between CMP steps and feedforward or feedback control. The dimensional variations in the substrate are captured after each polishing step at an in-sequence metrology station and used either to determine whether there is a need to rework the substrate, or fed forward or fed back to control the polishing operation or endpoint at a previous or subsequent polishing station.

The polishing apparatus is configured such that a carrier head holds a substrate during polishing at the first and second polishing stations and moves the substrate from the first polishing station to the second polishing station. The in-sequence metrology station is situated to measure the substrate when the carrier head is holding the substrate and when the substrate is not in contact with a polishing pad of either the first polishing station or the second polishing station.

Figure 1:
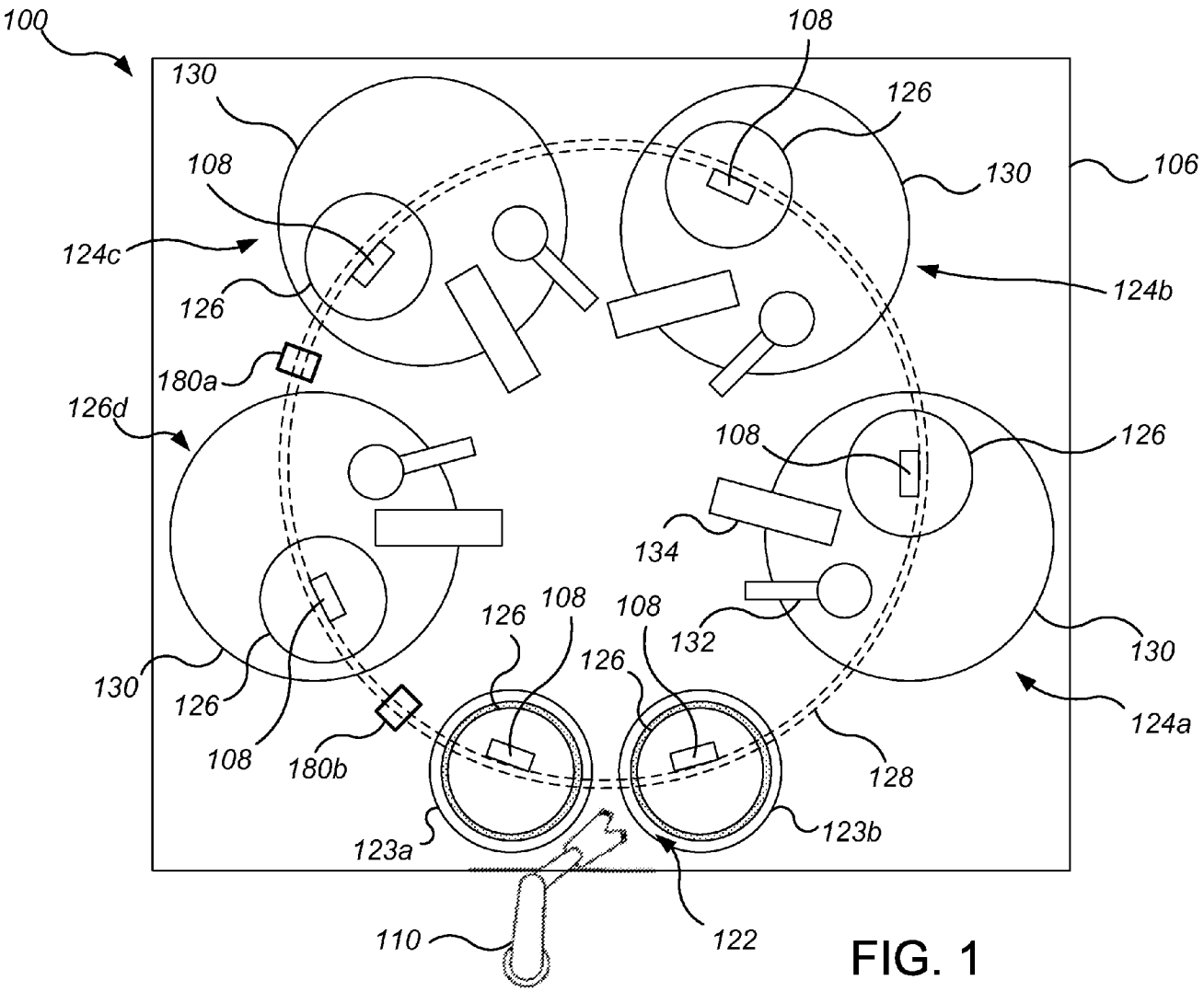
FIG. 1 is a schematic plan view of an example of a polishing apparatus.

FIG. 1 is a plan view of a chemical mechanical polishing apparatus 100 for processing one or more substrates. The polishing apparatus 100 includes a polishing platform 106 that at least partially supports and houses a plurality of polishing stations 124. The number of polishing stations can be an even number equal to or greater than four. For example, the polishing apparatus can include four polishing stations 124*a*, 124*b*, 124*c* and 124*d*. Each polishing station 124 is adapted to polish a substrate that is retained in a carrier head 126.

The polishing apparatus 100 also includes a multiplicity of carrier heads 126, each of which is configured to carry a substrate. The number of carrier heads can be an even number equal to or greater than the number of polishing stations, e.g., four carrier heads or six carrier heads. For example, the number of carrier heads can be two greater than the number of polishing stations. This permits loading and unloading of substrates to be performed from two of the carrier heads while polishing occurs with the other carrier heads at the remainder of the polishing stations, thereby providing improved throughput.

The polishing apparatus 100 also includes a transfer station 122 for loading and unloading substrates from the carrier heads. The transfer station 122 can include a plurality of load cups 123, e.g., two load cups 123*a*, 123*b*, adapted to facilitate transfer of a substrate between the carrier heads 126 and a factory interface (not shown) or other device (not shown) by a transfer robot 110. The load cups 123 generally facilitate transfer between the robot 110 and each of the carrier heads 126.

The stations of the polishing apparatus 100, including the transfer station 122 and the polishing stations 124, can be positioned at substantially equal angular intervals around the center of the platform 106. This is not required, but can provide the polishing apparatus with a good footprint.

Figure 2:
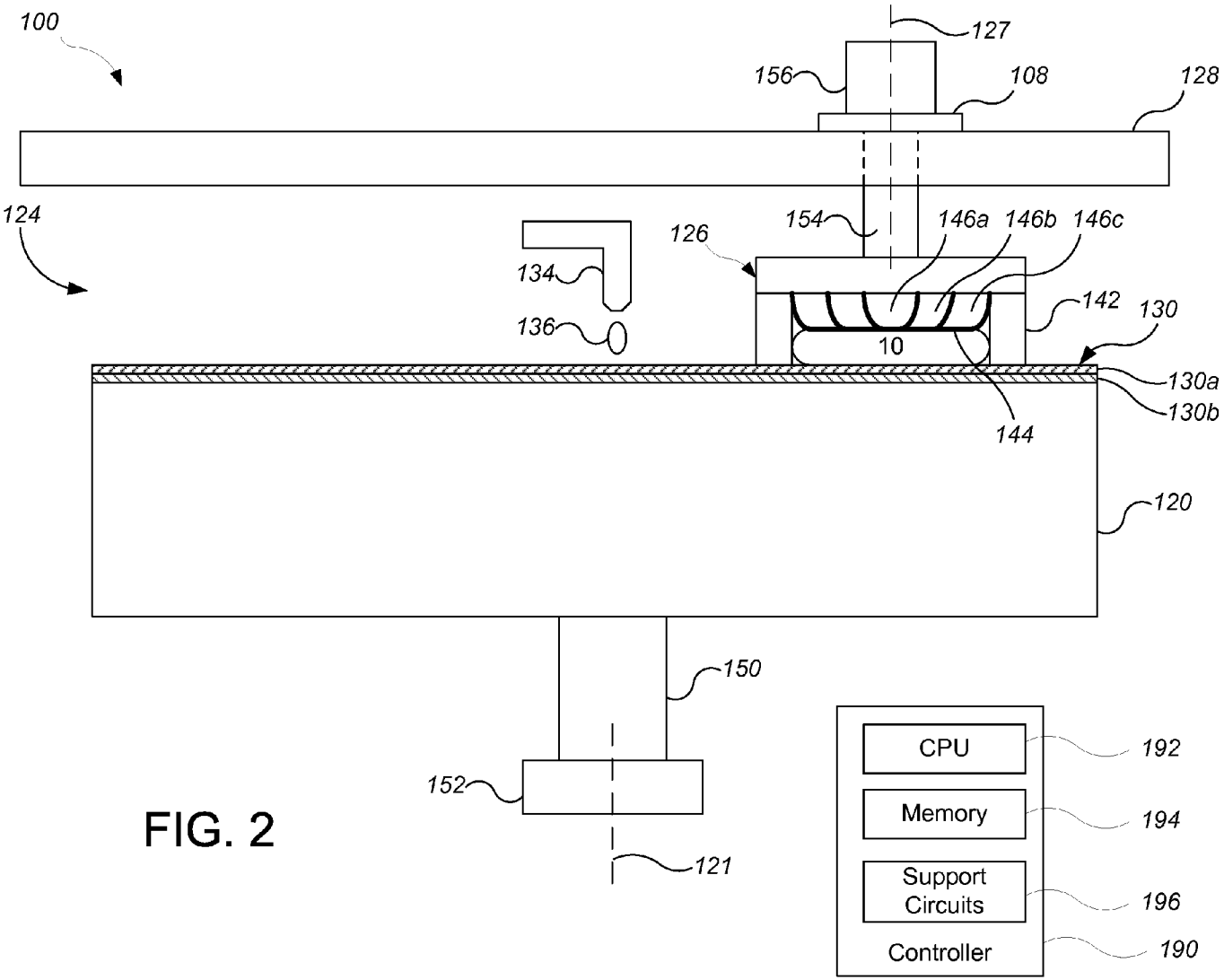
FIG. 2 is a schematic cross-sectional view of an example of a polishing apparatus.

Each polishing station 124 includes a polishing pad 130 supported on a platen 120 (see FIG. 2). The polishing pad 110 can be a two-layer polishing pad with an outer polishing layer 130*a* and a softer backing layer 130*b* (see FIG. 2).

For a polishing operation, one carrier head 126 is positioned at each polishing station. Two additional carrier heads can be positioned in the loading and unloading station 122 to exchange polished substrates for unpolished substrates while the other substrates are being polished at the polishing stations 124.

The carrier heads 126 are held by a support structure that can cause each carrier head to move along a path that passes, in order, the first polishing station 124*a*, the second polishing station 124*b*, the third polishing station 124*c*, and the fourth polishing station 126*d*. This permits each carrier head to be selectively positioned over the polishing stations 124 and the load cups 123.

In some implementations, each carrier head 126 is coupled to a carriage 108 that is mounted to an overhead track 128. By moving a carriage 108 along the overhead track 128, the carrier head 126 can be positioned over a selected polishing station 124 or load cup 123. A carrier head 126 that moves along the track will traverse the path past each of the polishing stations.

In the implementation depicted in FIG. 1, the overhead track 128 has a circular configuration (shown in phantom) which allows the carriages 108 retaining the carrier heads 126 to be selectively orbited over and/or clear of the load cups 122 and the polishing stations 124. The overhead track 128 may have other configurations including elliptical, oval, linear or other suitable orientation. Alternatively, in some implementations the carrier heads 126 are suspended from a carousel, and rotation of the carousel moves all of the carrier heads simultaneously along a circular path.

Each polishing station 124 of the polishing apparatus 100 can include a port, e.g., at the end of an arm 134, to dispense polishing liquid 136 (see FIG. 2), such as abrasive slurry, onto the polishing pad 130. Each polishing station 124 of the polishing apparatus 100 can also include pad conditioning apparatus 132 to abrade the polishing pad 130 to maintain the polishing pad 130 in a consistent abrasive state.

As shown in FIG. 2, the platen 120 at each polishing station 124 is operable to rotate about an axis 121. For example, a motor 150 can turn a drive shaft 152 to rotate the platen 120.

Each carrier head 126 is operable to hold a substrate 10 against the polishing pad 130. Each carrier head 126 can have independent control of the polishing parameters, for example pressure, associated with each respective substrate. In particular, each carrier head 126 can include a retaining ring 142 to retain the substrate 10 below a flexible membrane 144. Each carrier head 126 also includes a plurality of independently controllable pressurizable chambers defined by the membrane, e.g., three chambers 146*a*-146*c*, which can apply independently controllable pressurizes to associated zones on the flexible membrane 144 and thus on the substrate 10. Although only three chambers are illustrated in FIG. 2 for ease of illustration, there could be one or two chambers, or four or more chambers, e.g., five chambers.

Each carrier head 126 is suspended from the track 128, and is connected by a drive shaft 154 to a carrier head rotation motor 156 so that the carrier head can rotate about an axis 127. Optionally each carrier head 140 can oscillate laterally, e.g., by driving the carriage 108 on the track 128, or by rotational oscillation of the carousel itself. In operation, the platen is rotated about its central axis 121, and each carrier head is rotated about its central axis 127 and translated laterally across the top surface of the polishing pad. The lateral sweep is in a direction parallel to the polishing surface 212. The lateral sweep can be a linear or arcuate motion.

A controller 190, such as a programmable computer, is connected to each motor 152, 156 to independently control the rotation rate of the platen 120 and the carrier heads 126. For example, each motor can include an encoder that measures the angular position or rotation rate of the associated drive shaft. Similarly, the controller 190 is connected to an actuator in each carriage 108 to independently control the lateral motion of each carrier head 126. For example, each actuator can include a linear encoder that measures the position of the carriage 108 along the track 128.

The controller 190 can include a central processing unit (CPU) 192, a memory 194, and support circuits 196, e.g., input/output circuitry, power supplies, clock circuits, cache, and the like. The memory is connected to the CPU 192. The memory is a non-transitory computable readable medium, and can be one or more readily available memory such as random access memory (RAM), read only memory (ROM), floppy disk, hard disk, or other form of digital storage. In addition, although illustrated as a single computer, the controller 190 could be a distributed system, e.g., including multiple independently operating processors and memories.

This architecture is adaptable to various polishing situations based on programming of the controller 190 to control the order and timing that the carrier heads are positioned at the polishing stations.

For example, some polishing recipes are complex and require three of four polishing steps. Thus, a mode of operation is for the controller to cause a substrate to be loaded into a carrier head 126 at one of the load cups 123, and for the carrier head 126 to be positioned in turn at each polishing station 124*a*, 124*b*, 124*c*, 124*d* so that the substrate is polished at each polishing station in sequence. After polishing at the last station, the carrier head 126 is returned to one of the load cups 123 and the substrate is unloaded from the carrier head 126.

On the other hand, some polishing recipes require only two polishing steps. Thus, another mode of operation is for a first substrate to be loaded into a first carrier head 126 at a first load cup 123*a*, and a second substrate to be loaded into a second carrier head 126 at a second load cup 123*b* (see FIG. 3A). Then the two carrier heads are moved into position over the first two polishing stations. That is, the first carrier head 126 is moved to the second polishing station 124*b*, and the second carrier head 126 is moved to the first polishing station 124*a* (see FIG. 3B). Thus, the first carrier head 126 bypasses the first polishing station 124*a* (the first substrate is not polished at the first polishing station 124*a*). Similarly, the second polishing head 126 bypasses the second load cup 123*b* (the second substrate is not loaded or unloaded at the second load cup 123*b*). The first substrate is polished at the second polishing station 124*b* and the second substrate is polished at the first polishing station 124*a* simultaneously.

Once polishing is completed at the first two polishing stations, the two carrier heads are moved into position over the next two polishing stations. That is, the first carrier head 126 is moved to the fourth polishing station 124*d*, and the second carrier head 126 is moved to the third polishing station 124*c* (see FIG. 3C). Thus, the first carrier head 126 bypasses the third polishing station 124*a* (the first substrate is not polished at the third polishing station 124*c*). Similarly, the second polishing head 126 bypasses the second polishing station 124*b* (the second substrate is not loaded or unloaded at the second polishing station 124*b*). The first substrate is polished at the fourth polishing station 124*d* and the second substrate is polished at the third polishing station 124*c* simultaneously.

Once polishing of the first substrate is completed at the fourth polishing station 124*d*, the first carrier head 126 is moved to the second load cup 123*b*. Similarly, once polishing of the second substrate is completed at the third polishing station 124*c*, the second carrier head 126 is move to the first load cup. Thus, the first carrier head 126 bypasses the first load cup 123*a* (the first substrate is not loaded or unloaded at the first load cup 123*a*). Similarly, the second polishing head 126 bypasses the fourth polishing station 124*d* (the second substrate is not polished at the fourth polishing station 124*d*).

An advantage of this mode of operation is that it can provide high throughput at a reasonable footprint of the base 106, while avoiding problems such as coordinating endpoint control and cross-contamination that can occur when multiple substrates are polished on the same polishing pad.

An example of a polishing process that can use this mode of operation is metal polishing, e.g., copper polishing. For example, bulk polishing of a metal layer can be performed at the first polishing station 124*a* and the second polishing station 124*b*, and metal clearing and removal of the barrier layer can be performed at the third polishing station 124*c* and the second polishing station 124*d*.

Because the carrier heads 126 are on a track 128, each carrier head cannot advance on the path past the carrier head that is in front of it. Thus, some coordination is necessary by the controller 190 so a carrier head does not advance until the operation is complete at the next station.

Referring to FIGS. 1, 3A-3C and 4, the polishing apparatus 100 also one or more in-sequence (also referred to as in-line) metrology systems 160 (see FIG. 4), e.g., optical metrology systems, e.g., spectrographic metrology systems. An in-sequence metrology system is positioned within the polishing apparatus 100, but does not performs measurements during the polishing operation; rather measurements are collected between polishing operations, e.g., while the substrate is being moved from one polishing station to another. Alternatively, one or more of the in-sequence metrology systems 160 could be a non-optical metrology system, e.g., an eddy current metrology system or capacitive metrology system.

In some implementations, the polishing system includes two in-sequence metrology systems. The two in-sequence metrology systems could be on the path on opposite sides of a polishing station. For example, in some implementations (shown in FIGS. 1 and 3A) the polishing system 100 includes a first metrology system with a first probe 180*a* located between the third polishing station 124*c* and the fourth polishing station 124*d*, and a second metrology system with a second probe 180*b* located between the fourth polishing station 124*d* and the transfer station 122. As another example, in some implementations (shown in FIG. 5) the polishing system 100 includes a first metrology system with a first probe 180*a* located between the transfer station 122 and the first polishing station 124*a*, and a second metrology system with a second probe 180*b* located between the first polishing station 124*a* and the second polishing station 124*b*.

Each in-line metrology system 160 includes a probe 180 supported on the platform 106 at a position on the path taken by the carrier heads 126 and between two of the stations, e.g., between two polishing stations 124, or between a polishing station 124 and the transfer station g stations 122. In particular, the probe 180 is located at a position such that a carrier head 126 supported by the track 128 can position the substrate 10 over the probe 180.

In some modes of operation, the substrate is measured an in-sequence metrology station 160 before polishing at a station. In this case, in some implementations, the probe 180 of the metrology station 160 can be positioned on the path after the polishing station. Thus, the carrier head 126 with an attached substrate is moved along the path past the polishing station 124 to the probe 180 of the in-sequence monitoring station, the substrate is measured with the probe 180, and the carrier head is moved back along the path (in a reverse direction) to the polishing station 124.

Figure 3B:
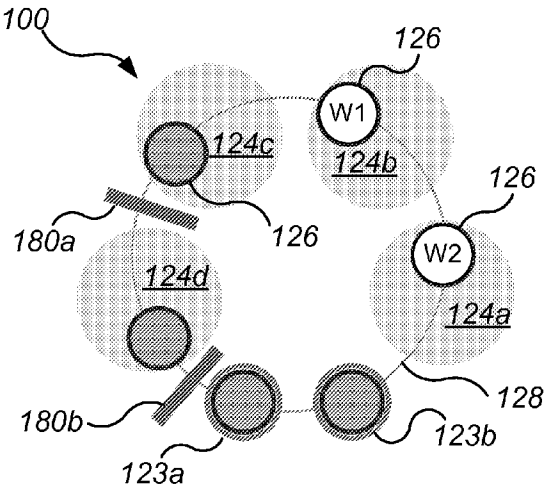
FIGS. 3A-3C illustrate a method of operation of the polishing apparatus.
Figure 3A:
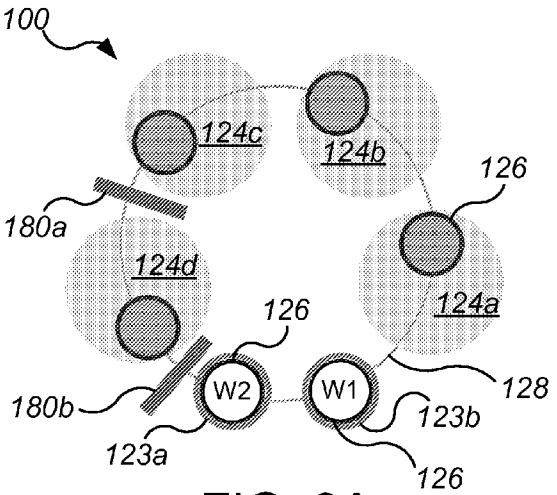
Figure 3C:
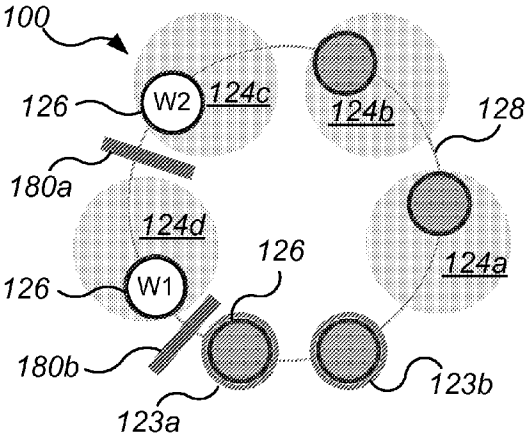
Figure 4:
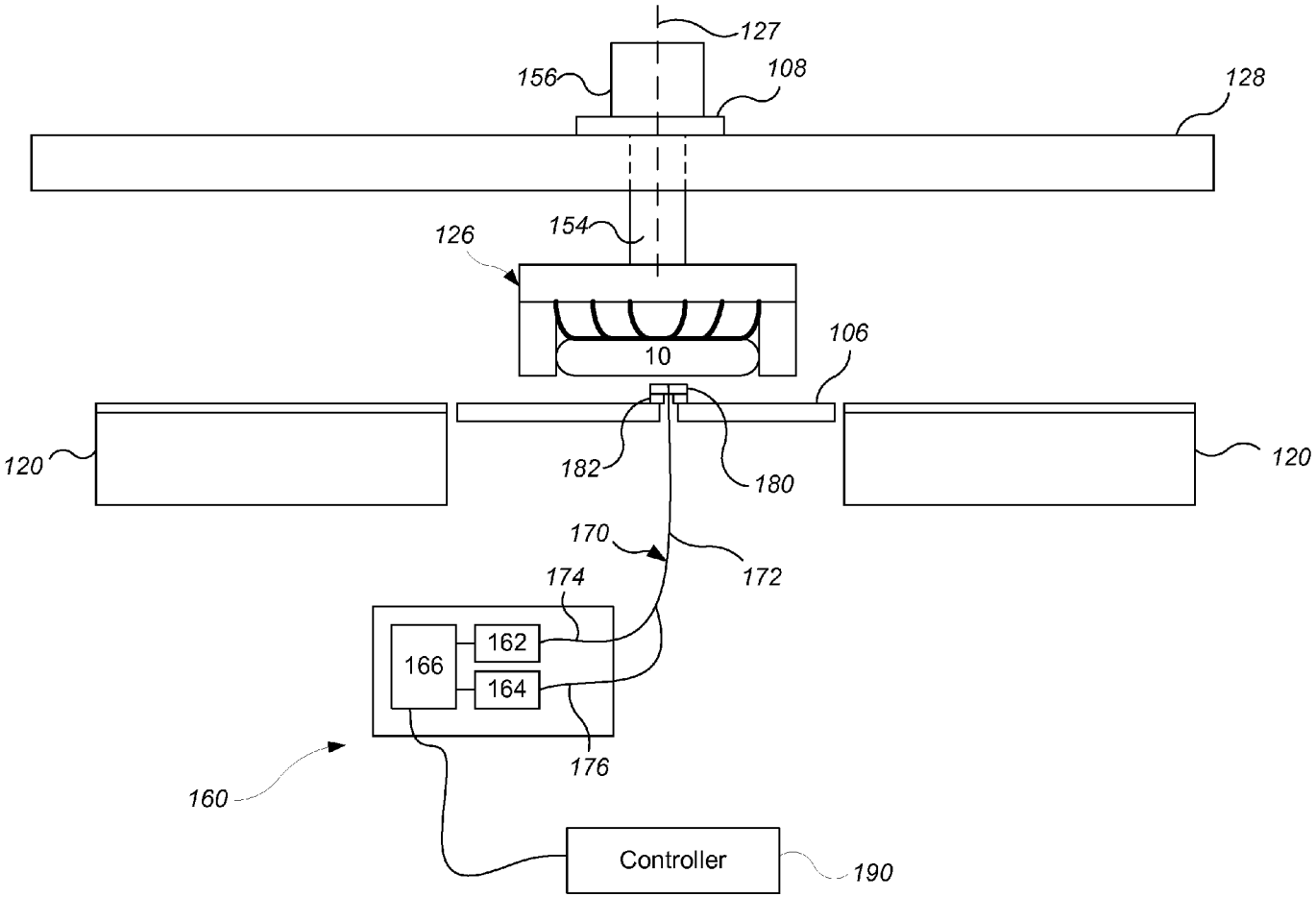
FIG. 4 is a schematic cross-sectional view of an example of an in-sequence optical metrology system.

For example, referring to FIGS. 3B and 3C, once polishing of the first substrate is completed at the second polishing station 124*b*, the substrate can be moved past the third polishing station 124*c* and fourth polishing station 124*d* to the second probe 180*b*, measured with the second probe 180*b*, and moved back along the path to the fourth polishing station 124*d*. Similarly, once polishing of the second substrate is completed at the first polishing station 124*a*, the substrate can be moved past the second polishing station 124*b* and third polishing station 124*c* to the first probe 180*a*, measured with the first probe 180*a*, and moved back along the path to the third polishing station 124*c*.

In some modes of operation, the substrate is measured an in-sequence metrology station 160 after polishing at a station. In this case, in some implementations, the probe 180 of the metrology station 160 can be positioned on the path before the polishing station. Thus, the carrier head 126 with an attached substrate is moved along the path past the probe 180 of the in-sequence monitoring station to the polishing station 124, the substrate is polished at the polishing station 124, the carrier head is moved back along the path (in a reverse direction) to the probe 180, the substrate is measured, and the carrier head is forward again along the path past the polishing station 124 to the next station.

Figure 5:
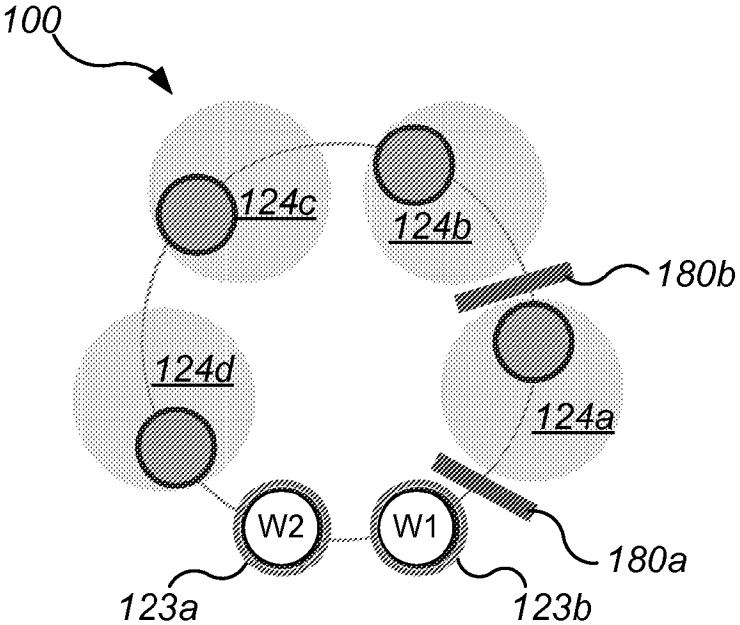
FIG. 5 illustrates another implementation of a polishing apparatus.

For example, referring to FIG. 5, once the first substrate is loaded into the carrier head 126 at the second loading cup 123*b*, the first substrate is moved past the first probe 180*a*, the first polishing station 124*a* and the second probe 180*b* to the second polishing station 124*b*. Once the first substrate is completed at the second polishing station 124*b*, the first substrate is moved back along the path to the second probe 180*b*, measured with the second probe 180*b*, and then moved forward along the path to the fourth polishing station 124*d*. Similarly, once the second substrate is loaded into the carrier head 126 at the first loading cup 123*a*, the second substrate is moved past second loading cup 123*b*, and the first probe 180*a* to the first polishing station 124*a*. Once polishing of the second substrate is completed at the first polishing station 124*a*, the substrate is moved back along the path to the first probe 180*a*, measured with the first probe 180*a*, and then forward along the path to the third polishing station 124*c*.

In some implementations, the probe 180 of the metrology station 160 can be positioned on the path after the polishing station and be used for a measurement after polishing of the substrate at the polishing station. For example, in the implementations shown in FIGS. 1 and 3A, the first probe 180*a* and second probe 180*b* can be used for measuring the second substrate and first substrate after polishing at the third polishing station 124*c* and fourth polishing station 124*d*, respectively.

In some implementations, the probe 180 of the metrology station 160 can be positioned on the path before the polishing station and be used for a measurement before polishing of the substrate at the polishing station. For example, in the implementations shown in FIG. 5, the first probe 180*a* and second probe 180*b* can be used for measuring the second substrate and first substrate before polishing at the first polishing station 124*a* and second polishing station 124*b*, respectively.

Figure 6:
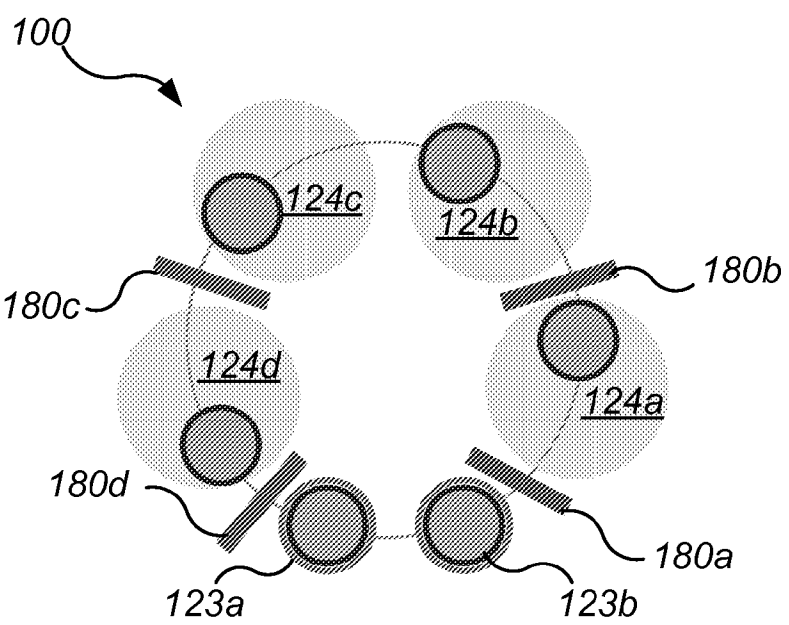
FIG. 6 illustrates another implementation of a polishing apparatus having four in-sequence metrology stations.

Referring to FIG. 6, in some implementations, the polishing system 100 includes four in-sequence metrology stations. For example, the polishing system 100 can include a first probe 180*a* between the second load cup 123*b* and the first polishing station 124*a*, a second probe 180*b* between the first polishing station 124*a* and the second polishing station 124*b*, a third probe 180*b* between the third polishing station 124*c* and the fourth polishing station 124*d*, and fourth probe 180*d* between the fourth polishing station 124*d* and the first load cup 123*a*.

An advantage of having two (or four) in-sequence metrology stations 160 is that measurements can be performed simultaneously on the two substrates. However, the techniques of moving a carrier head backward on the path to a probe or a polishing station can be applied even if there is only one in-sequence metrology station. In addition, although this examples focus on a polishing system with four polishing stations, the techniques can be applied to nearly any system with multiple polishing stations.

For example, a polishing system could include the four platens as shown in FIG. 1, but only a single in-sequence metrology station, e.g., with the probe positioned between the third polishing station 124*c* and the fourth polishing station 124*d*. In this case, for a measurement before the second polishing step, the first substrate would be measured with the probe and then move forward along the path to the fourth polishing station 124*d*, whereas the third substrate would be measured with the probe and then move backward along the path to the third polishing station 124*c*.

As another example, a polishing system could include the four platens as shown in FIG. 1, but only a single in-sequence metrology station, e.g., with the probe positioned between the first polishing station 124*a* and the second polishing station 124*b*. In this case, for a measurement after the first polishing step, the first substrate would move backwards from the second polishing station 124*b* to the probe, be measured with the probe and then move forward along the path to the fourth polishing station 124*d*, whereas the third substrate would move forward from the first polishing station 124*a*, be measured with the probe and then move forward to the third polishing station 124*c*.

As another example, a polishing system could include the four platens as shown in FIG. 2 and two in-sequence metrology station, but with a first probe positioned between the first polishing station 124*a* and the second polishing station 124*b* and a second probe positioned between the third polishing station 124*c* and the fourth polishing station 124*d*. Such as system could function as provided in either of the two prior examples.

In some implementations, the probe 180 should be positioned adjacent a station at which the filler layer is expected to be cleared. For example, where the controller 190 is configured with a recipe to perform bulk polishing (but not clearance) of the filler layer at the first and second polishing stations, and removal or clearing of an underlying layer at the third and fourth polishing stations, the probe 180 can be positioned adjacent either the third or fourth polishing stations.

Figure 7:
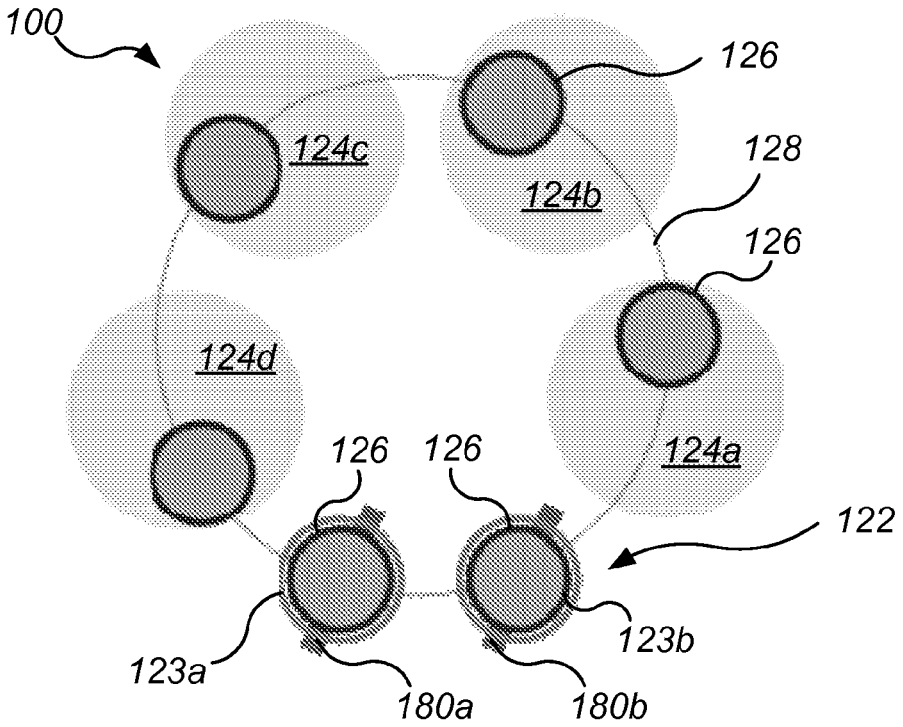
FIG. 7 illustrates another implementation of a polishing apparatus having in-sequence metrology stations integrated into the transfer station.

Referring to FIG. 7, in another implementation, at least one probe 180 of an in-sequence metrology system is positioned in the transfer station 122. For example, two probes 180*a* and 180*b* of two in-sequence metrology systems are positioned in the respective load cups 123*a* and 123*b* of the transfer station 122. In operation, two substrates held by the two carrier heads 126 could be measured at the two load cups 123*a* and 123*b*. The measurement could occur before the substrate is polished at the first polishing station 124*a*, or after the substrate is polished at the last polishing station 124*d*.

Alternatively or in addition, one or both carrier heads could be moved back along the track 128 after polishing at the first station 124*a* or second station 124*b* to be measured and then transported forward to the third station 124*b* or fourth station 124*d*, and/or one or both carrier heads could be moved forward along the track past the third station 124*c* or the fourth station 124*d* prior to polishing at those stations to be measured and then transported back to the third station 124*b* or fourth station 124*d*.

Figure 8:
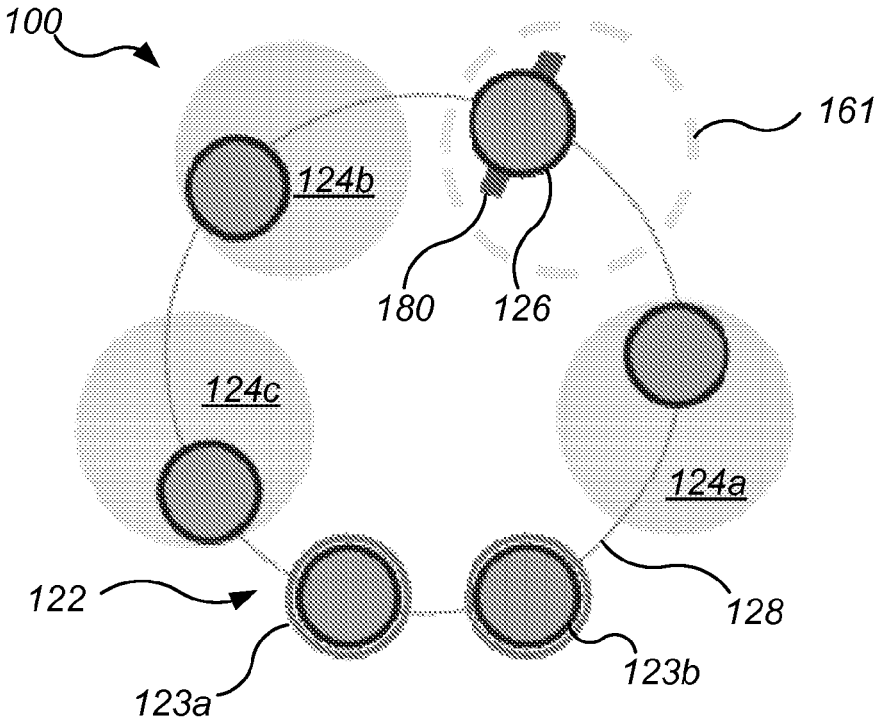
FIG. 8 illustrates another implementation of a polishing apparatus in which a polishing station is replaced with an in-sequence metrology station.

Referring to FIG. 8, in another implementation, one of the polishing stations is replaced by a metrology station 161, with the probe 180 of the in-sequence metrology system positioned in the metrology station. The stations of the polishing apparatus 100, including the transfer station 122, the polishing stations 124 and the metrology station 161, can be positioned at substantially equal angular intervals around the center of the platform 106. In the example shown in FIG. 8, there are three polishing stations 124*a*, 124*b* and 124*c*. In general, the polishing apparatus illustrated in FIG. 8 could be used in a sequential polishing operation, e.g., a carrier head 126 would move to each polishing station 124*a*, 124*b*, 124*c* in turn and perform a polishing operation at that polishing station. An advantage of this architecture is compact size while enabling common three-step polishing processes and permitting in-sequence metrology.

In operation, the metrology station 161 could simply be used to measure the substrate between polishing operations at the first station 124*a* and the second polishing station 124*b*. However, the backtracking approach discussed above can also be applied. For example, a carrier heads could be moved back along the track 128 after polishing at the second station 124*b* to measure the substrate at the station 161, and then the carrier head 126 can be transported forward to the third station 124*b*. As another example, a carrier head could be moved forward along the track past the first station 124*a* prior to polishing at that station, the substrate could be measured at the metrology station 161, and then the carrier head can be transported back along the track 128 to the first station 124*a*.

Although only one probe 180*a* is illustrated in FIG. 8, the metrology station 161 could include two probes for two separate in-sequence metrology systems to permit two substrates to be measured simultaneously at the metrology station 161. In addition, the metrology station 161 could be positioned between the second station 124*b* and the third station 124*c*, with appropriate modification of the order of transfer between the stations.

Returning to FIG. 4, the optical metrology system 160 can include a light source 162, a light detector 164, and circuitry 166 for sending and receiving signals between the controller 190 and the light source 162 and light detector 164.

One or more optical fibers can be used to transmit the light from the light source 162 to the optical access in the polishing pad, and to transmit light reflected from the substrate 10 to the detector 164. For example, a bifurcated optical fiber 170 can be used to transmit the light from the light source 162 to the substrate 10 and back to the detector 164. The bifurcated optical fiber can include a trunk 172 having an end in the probe 180 to measure the substrate 10, and two branches 174 and 176 connected to the light source 162 and detector 164, respectively. In some implementations, rather than a bifurcated fiber, two adjacent optical fibers can be used.

In some implementations, the probe 180 holds an end of the trunk 172 of the bifurcated fiber. In operation, the carrier head 126 positions a substrate 10 over the probe 180. Light from the light source 162 is emitted from the end of the trunk 172, reflected by the substrate 10 back into the trunk 172, and the reflected light is received by the detector 164. In some implementations, one or more other optical elements, e.g., a focusing lens, are positioned over the end of the trunk 172, but these may not be necessary.

The probe 180 can include a mechanism to adjust the vertical height of the end the trunk 172, e.g., the vertical distance between the end of the trunk 172 and the top surface of the platform 106. In some implementations, the probe 180 is supported on an actuator system 182 that is configured to move the probe 180 laterally in a plane parallel to the plane of the track 128. The actuator system 182 can be an XY actuator system that includes two independent linear actuators to move probe 180 independently along two orthogonal axes.

The output of the circuitry 166 can be a digital electronic signal that passes to the controller 190 for the optical metrology system. Similarly, the light source 162 can be turned on or off in response to control commands in digital electronic signals that pass from the controller 190 to the optical metrology system 160. Alternatively, the circuitry 166 could communicate with the controller 190 by a wireless signal.

The light source 162 can be operable to emit white light. In one implementation, the white light emitted includes light having wavelengths of 200-800 nanometers. A suitable light source is a xenon lamp or a xenon mercury lamp.

Figure 9:
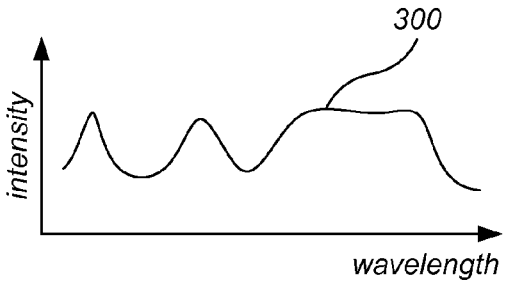
FIG. 9 illustrates an example spectrum.

The light detector 164 can be a spectrometer. A spectrometer is an optical instrument for measuring intensity of light over a portion of the electromagnetic spectrum. A suitable spectrometer is a grating spectrometer. Typical output for a spectrometer is the intensity of the light as a function of wavelength (or frequency). FIG. 9 illustrates an example of a measured spectrum 300.

As noted above, the light source 162 and light detector 164 can be connected to a computing device, e.g., the controller 190, operable to control their operation and receive their signals. The computing device can include a microprocessor situated near the polishing apparatus, e.g., a programmable computer. With respect to control, the computing device can, for example, synchronize activation of the light source with the motion of the carrier head 126.

Optionally, the in-sequence metrology system 160 can be a wet metrology system. In a wet-metrology system, measurement of the surface of the substrate is conducted while a layer of liquid covers the portion of the surface being measured. An advantage of wet metrology is that the liquid can have a similar index of refraction as the optical fiber 170. The liquid can provide a homogeneous medium through which light can travel to and from the surface of the film that is to be or that has been polished. The wet metrology system 169 can be configured such that the liquid is flowing during the measurement. A flowing liquid can flush away polishing residue, e.g., slurry, from the surface of the substrate being measured.

Figure 10:
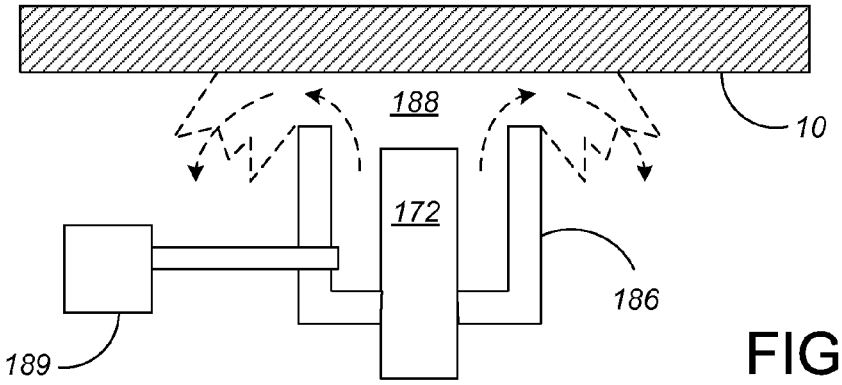
FIG. 10 is a schematic cross-sectional view of a wet-process optical metrology system.

FIG. 10 shows an implementation of a wet in-sequence metrology system 160. In this implementation, the trunk 172 of the optical fiber 170 is situated inside a tube 186. A liquid 188, e.g., de-ionized water, can be pumped from a liquid source 189 into and through the tube 186. During the measurement, the substrate 10 can positioned over the end of the optical fiber 170. The height of the substrate 10 relative to the top of the tube 186 and the flow rate of the liquid 188 is selected such that as the liquid 188 overflows the tube 186, the liquid 188 fills the space between the end of the optical fiber 170 and the substrate 10.

Figure 11:
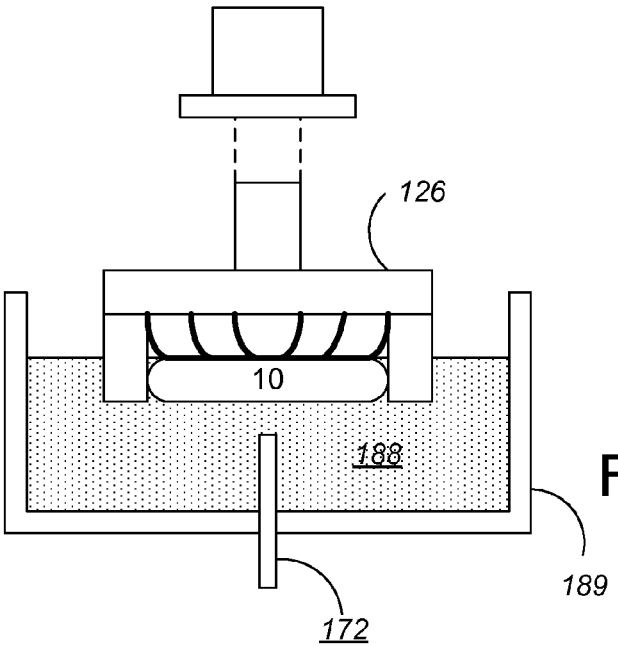
FIG. 11 is a schematic cross-sectional view of another implementation of a wet-process optical metrology system.

Alternatively, as shown in FIG. 11, the carrier head 126 can be lowered into a reservoir defined by a housing 189. Thus, the substrate 10 and a portion of the carrier head 126 can be submerged in a liquid 188, e.g., de-ionized water, in the reservoir. The end of the optical fiber 170 can be submerged in the liquid 188 below the substrate 10.

In either case, in operation, light travels from the light source 162, travels through the liquid 188 to the surface of the substrate 10, is reflected from the surface of the substrate 10, enters the end of the optical fiber, and returns to the detector 164.

Figure 12:
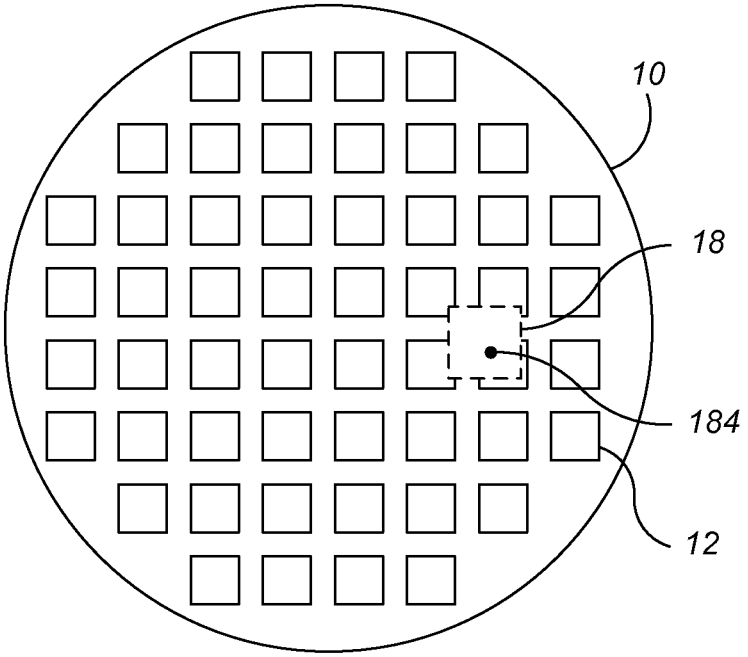
FIG. 12 is a schematic top view of a substrate.

Referring to FIG. 12, a typical substrate 10 includes multiple dies 12. In some implementations, the controller 190 causes the substrate 10 and the probe 180 to undergo relative motion so that the optical metrology system 160 can make multiple measurements within an area 18 on the substrate 10. In particular, the optical metrology system 160 can take multiple measurements at spots 184 (only one spot is shown on FIG. 5 for clarity) that are spread out with a substantially uniform density over the area 18. The area 18 can be equivalent to the area of a die 12. In some implementations, the die 12 (and the area 18) can be considered to include half of any adjacent scribe line. In some implementations, at least one-hundred measurements are made within the area 18. For example, if a die is 1 cm on a side, then the measurements can be made at 1 mm intervals across the area. The edges of the area 18 need not be aligned with the edges of a particular die 12 on the substrate.

In some implementations, the XY actuator system 182 causes the measurement spot 184 of the probe 180 to traverse a path across the area 18 on the substrate 10 while the carrier head 126 holds the substrate 10 in a fixed position (relative to the platform 106). For example, the XY actuator system 182 can cause the measurement spot 184 to traverse a path which traverses the area 18 on a plurality of evenly spaced parallel line segments. This permits the optical metrology system 160 to take measurements that are evenly spaced over the area 18.

In some implementations, there is no actuator system 182, and the probe 180 remains stationary (relative to the platform 106) while the carrier head 126 moves to cause the measurement spot 184 to traverse the area 18. For example, the carrier head could undergo a combination of rotation (from motor 156) translation (from carriage 108 moving along track 128) to cause the measurement spot 184 to traverse the area 18. For example, the carrier head 126 can rotate while carriage 108 causes the center of the substrate to move outwardly from the probe 180, which causes the measurement spot 184 to traverse a spiral path on the substrate 10. By making measurements while the spot 184 is over the area 18, measurements can be made at a substantially uniform density over the area 18.

In some implementations, the relative motion is caused by a combination of motion of the carrier head 126 and motion of the probe 180, e.g., rotation of the carrier head 126 and linear translation of the probe 180.

The controller 190 receives a signal from the optical metrology system 160 that carries information describing a spectrum of the light received by the light detector for each flash of the light source or time frame of the detector. For each measured spectrum, a characterizing value can be calculated from the measured spectrum. The characterizing value can be used in controlling a polishing operation at one or more of the polishing stations.

One technique to calculate a characterizing value is, for each measured spectrum, to identify a matching reference spectrum from a library of reference spectra. Each reference spectrum in the library can have an associated characterizing value, e.g., a thickness value or an index value indicating the time or number of platen rotations at which the reference spectrum is expected to occur. By determining the associated characterizing value for the matching reference spectrum, a characterizing value can be generated. This technique is described in U.S. Patent Publication No. 2010-0217430, which is incorporated by reference. Another technique is to analyze a characteristic of a spectral feature from the measured spectrum, e.g., a wavelength or width of a peak or valley in the measured spectrum. The wavelength or width value of the feature from the measured spectrum provides the characterizing value. This technique is described in U.S. Patent Publication No. 2011-0256805, which is incorporated by reference. Another technique is to fit an optical model to the measured spectrum. In particular, a parameter of the optical model is optimized to provide the best fit of the model to the measured spectrum. The parameter value generated for the measured spectrum generates the characterizing value. This technique is described in U.S. Patent Application No. 61/608,284, filed Mar. 8, 2012, which is incorporated by reference. Another technique is to perform a Fourier transform of the measured spectrum. A position of one of the peaks from the transformed spectrum is measured. The position value generated for for measured spectrum generates the characterizing value. This technique is described in U.S. patent application Ser. No. 13/454,002, filed Apr. 23, 2012, which is incorporated by reference.

As noted above, the characterizing value can be used in controlling a polishing operation at one or more of the polishing stations. The controller can, for example, calculate the characterizing value and adjust the polishing time, polishing pressure, or polishing endpoint of: (i) the previous polishing step, i.e., for a subsequent substrate at the polishing station that the substrate being measured just left, (ii) the subsequent polishing step, i.e., at the polishing station to which the substrate being measured will be transferred, or (iii) both of items (i) and (ii), based on the characterizing value.

In some implementations, prior to the first CMP step, substrate dimension information (layer thickness, critical dimensions) from upstream non-polishing steps, if available, is fed forward to the controller 190.

After a CMP step, the substrate is measured using wet metrology at the in-sequence metrology station 180 located between the polishing station at which the substrate was polishing and the next polishing station. A characterizing value, e.g., layer thickness or copper line critical dimension, is captured and sent to the controller.

In some implementations, the controller 190 uses the characterizing value to adjust the polishing operation for the substrate at the next polishing station. For example, if the characterizing value indicates that the etch trench depth is greater, the post thickness target for the subsequent polishing station can be adjusted with more removal amount to keep the remaining metal line thickness constant. If the characterizing value indicates that the underlying layer thickness has changed, the reference spectrum for in-situ endpoint detection at the subsequent polishing station can be modified so that endpoint occurs closer to the target metal line thickness.

In some implementations, the controller 190 uses the characterizing value to adjust the polishing operation for a subsequent substrate at the previous polishing station. For example, if the characterizing value indicates that the etch trench depth is greater, the post thickness target for the previous polishing station can be adjusted with more removal amount to keep the remaining metal line thickness constant. If the characterizing value indicates that the underlying layer thickness has changed, the reference spectrum for in-situ endpoint detection at the previous polishing station can be modified so that endpoint occurs closer to the target metal line thickness.

In some implementations, the controller 190 analyzes the measured spectra and determines the proper substrate route. For example, the controller 190 can compare the characterizing value to a threshold, or determine whether the characterizing value falls within a predetermined range. If the characterizing value indicates that polishing is incomplete, e.g., if it falls within the predetermined range indicating an under-polished substrate or does not exceed a threshold indicating a satisfactorily polished substrate, then the substrate can be routed back to previous polishing station for rework. For example, Once the rework is completed, the substrate can be measured again at the metrology station, or transported to the next polishing station. If the characterizing value does not indicate that polishing is incomplete, the substrate can be transported to the next polishing station.

For example, a parameter such as metal residue can be measured using wet metrology at the in-sequence metrology station 180. If metal residue detected, the substrate can be routed back to previous polishing station for rework. Otherwise, the substrate can be transported to the next polishing station.

In order to detect metal residue, the controller 190 can evaluate the percentage of the area that is covered by the filler material. Each measured spectrum 300 is compared to a reference spectrum. The reference spectrum can be the spectrum from a thick layer of the filler material, e.g., a spectrum from a metal, e.g., a copper or tungsten reference spectrum. The comparison generates a similarity value for each measured spectrum 300. A single scalar value representing the amount of filler material within the area 18 can be calculated from the similarity values, e.g., by averaging the similarity values. The scalar value can then be compared to a threshold to determine the presence and/or amount of residue in the area.

In some implementations, the similarity value is calculated from a sum of squared differences between the measured spectrum and the reference spectrum. In some implementations, the similarity value is calculated from a cross-correlation between the measured spectrum and the reference spectrum.

For example, in some implementation a sum of squared differences (SSD) between each measured spectrum and the reference spectrum is calculated to generate an SSD value for each measurement spot. The SSD values can then be normalized by dividing all SSD values by the highest SSD value obtained in the scan to generate normalized SSD values (so that the highest SSD value is equal to 1). The normalized SSD values are then subtracted from 1 to generate the similarity value. The spectrum that had the highest SSD value, and thus the smallest copper contribution, is now equal to 0.

Then the average of all similarity values generated in the prior step is calculated to generate the scalar value. This scalar value will be higher if residue is present.

As another example, in some implementation a sum of squared differences (SSD) between each measured spectrum and the reference spectrum is calculated to generate an SSD value for each measurement spot. The SSD values can then be normalized by dividing all SSD values by the highest SSD value obtained in the scan to generate normalized SSD values (so that the highest SSD value is equal to 1). The normalized SSD values are then subtracted from 1 to generate inverted normalized SSD values. For a given spectrum, if the inverted normalized SSD value generated in the previous step is less than a user-defined threshold, then it is set to 0. The user-defined threshold can be 0.5 to 0.8, e.g., 0.7. Then the average of all values generated in the prior step is calculated to generate the scalar value. Again, this similarity value will be higher if residue is present.

If the calculated scalar value is greater than a threshold value, then the controller 190 can designate the substrate as having residue. On the other hand, if the scalar value is equal or less than the threshold value, then the controller 190 can designate the substrate as not having residue.

If the controller 190 does not designate the substrate as having residue, then the controller can cause the substrate to be processed at the next polishing station normally. On the other hand, controller 190 designates the substrate as having residue, then the controller can take a variety of actions. In some implementations, the substrate can be returned immediately to the previous polishing station for rework. In some implementations, the substrate is returned to the cassette (without being processed at a subsequent polishing station) and designated for rework once other substrates in the queue have completed polishing. In some implementations, the substrate is returned to the cassette (without being processed at a subsequent polishing station), and an entry for the substrate in a tracking database is generated to indicate that the substrate has residue. In some implementations, the scalar value can be used to adjust a subsequent polishing operation to ensure complete removal of the residue. In some implementations, the scalar value can be used to flag the operator that something has gone wrong in the polishing process, and that the operator's attention is required. The tool can enter into a number of error/alarm states, e.g. return all substrates to a cassette and await operator intervention.

In another implementation, the calculated similarity value for each measurement value is compared to a threshold value. Based on the comparison, each measurement spot is designated as either filler material or not filler material. For example, if an inverted normalized SSD value is generated for each measurement spot as discussed above, then the user-defined threshold can be 0.5 to 0.8, e.g., 0.7.

The percentage of measurement spots within the area 18 that are designated as filler material can be calculated. For example, the number of measurement spots designated as filler material can be divided by the total number of measurement spots.

This calculated percentage can be compared to a threshold percentage. The threshold percentage can be calculated either from knowledge of pattern of the die on the substrate, or empirically by measuring (using the measurement process described above) for a sample substrate that is known to not have residue. The sample substrate could be verified as not having residue by a dedicated metrology station.

If the calculated percentage is greater than the threshold percentage, then the substrate can be designated as having residue. On the other hand, if the percentage is equal or less than the threshold percentage, then the substrate can be designated as not having residue. The controller 190 can then take action as discussed above.

In some implementations a probe 180' of an optical metrology system 160 is positioned between the loading and unloading station and one of the polishing stations. If the probe 180' is positioned between the loading station and the first polishing station, then a characterizing value can be measured by the metrology system and fed forward to adjust polishing of the substrate at first polishing station. If the probe 180' is positioned between the last polishing station and the unloading station, then a characterizing value can be measured by the metrology system and fed back to adjust polishing of a subsequent substrate at the last polishing station, or if residue is detected then the substrate can be sent back to the last polishing station for rework.

The control schemes described above can more reliably maintain product substrates within manufacture specification, and can reduce rework, and can provide rerouting of the substrate to provide rework with less disruption of throughput. This can provide an improvement in both productivity and yield performance.

The above described polishing apparatus and methods can be applied in a variety of polishing systems. For example, rather than be suspended from a track, multiple carrier heads can be suspended from a carousel, and lateral motion of the carrier heads can be provided by a carriage that is suspend from and can move relative to the carousel. The platen may orbit rather than rotate. The polishing pad can be a circular (or some other shape) pad secured to the platen. Some aspects of the endpoint detection system may be applicable to linear polishing systems (e.g., where the polishing pad is a continuous or a reel-to-reel belt that moves linearly). The polishing layer can be a standard (for example, polyurethane with or without fillers) polishing material, a soft material, or a fixed-abrasive material. Terms of relative positioning are used; it should be understood that the polishing surface and substrate can be held in a vertical orientation or some other orientations.

While the foregoing is directed to embodiments of the present invention, other and further embodiments of the invention may be devised without departing from the basic scope thereof, and the scope thereof is determined by the claims that follow.

What is claimed is:

1. A polishing apparatus comprising:

N polishing stations, where N is an even number equal to or greater than 4, each polishing station including a platen to support a polishing pad;

an even number of carrier heads held by a support structure and movable to the N polishing stations in sequence, the N polishing stations including a first polishing station, a second polishing station, a third polishing station and a fourth polishing station;

a transfer station; and a controller configured to cause two substrates to be loaded into two of the carrier heads in the transfer station, move the two of the carrier heads to a first pair of the N polishing stations, simultaneously polish the two substrates in a first polishing step at the first pair of the N polishing stations, move the two of the carrier heads to a second pair of the N polishing stations, simultaneously polish the two substrates in a second polishing step at the second pair of the N polishing stations, move the two of the carrier heads to the transfer station, and cause the two substrates to be unloaded from the two of the carrier heads;

wherein the controller is configured to move the two of the carrier heads to the first pair of the N polishing stations by moving a first carrier head with a first substrate from the transfer station through the first polishing station of the N polishing stations to the second polishing station of the N polishing stations without polishing the first substrate at the first polishing station and moving a second carrier head with a second substrate from the transfer station to the first polishing station, and wherein the controller is configured to move the two of the carrier heads to the second pair of the N polishing stations by moving the first carrier head with the first substrate from the second polishing station through the third polishing station of the N polishing stations to the fourth polishing station of the N polishing stations without polishing the first substrate at the third polishing station and moving the second carrier head with the second substrate from the first polishing station through the second polishing station to the third polishing station without polishing the second substrate at the second polishing station.

2. The polishing apparatus of claim 1, wherein the number of carrier heads equals N+2.

3. The polishing apparatus of claim 1, wherein the number of carrier heads equals N.

4. The polishing apparatus of claim 1, wherein N is 4.

5. The polishing apparatus of claim 1, wherein the transfer station includes two load cups.

6. The polishing apparatus of claim 5, wherein the controller is configured to cause the first substrate of the two substrates to be loaded into the first carrier head at a first load cup of the two load cups, and moved from the first load cup past the first polishing station to the second polishing station.

7. The polishing apparatus of claim 1, wherein the polishing stations and transfer station are supported on a platform and positioned at substantially equal angular intervals around a center of the platform.

8. The polishing apparatus of claim 1, wherein the controller is configured operate in one of a plurality of modes, and in a first mode of the plurality of modes the controller causes the two of the carrier heads to move to the first pair of the N polishing stations, and in a second mode of the plurality of modes the controller causes a carrier head to move sequentially to each of the N polishing stations and cause the substrate to be polished at each of the N polishing stations.

9. The polishing apparatus of claim 1, comprising two in-sequence metrology stations.

10. The polishing apparatus of claim 9, wherein a first probe of the two in-sequence metrology stations is positioned between a first station and a second station of the second pair of polishing stations and a second probe of the two in-sequence metrology stations is positioned between the second station and the transfer station.

11. The polishing apparatus of claim 9, wherein a first probe of the two in-sequence metrology stations is positioned between a first station of the first pair of polishing stations and the transfer station and a second probe of the two in-sequence metrology stations is positioned between the first station and a second station of the first pair of polishing stations.

12. A polishing apparatus comprising:

five stations supported on a platform and positioned at substantially equal angular intervals around a center of the platform, the five stations including four polishing stations and a transfer station, each polishing station including a platen to support a polishing pad; and a plurality of carrier heads suspended from and movable along a track such that each carrier head is selectively positionable at the stations.

13. The polishing apparatus of claim 12, wherein the track is circular.

14. The apparatus of claim 1, wherein the controller is configured to move the first carrier head with the first substrate from the fourth polishing station to the transfer station, and to move the second carrier head with the second substrate from the third polishing station through the fourth polishing station to the transfer station without polishing the second substrate at the fourth polishing station.

15. The polishing apparatus of claim 6, wherein the controller is configured to cause the second substrate of the two substrates to be loaded into the second carrier head at a second load cup of the two load cups, moved past the first load cup of the two load cups to the first polishing station, and polished at the first polishing station.

16. The polishing apparatus of claim 15, wherein the controller is configured to cause the first substrate of the two substrates to be moved from the fourth polishing station past the second load cup of the two load cups to the first load cup of the two load cups and unloaded at the first load cup.

17. The polishing apparatus of claim 1, wherein the support structure comprises a track and the plurality of carrier heads are suspended from the track.

18. The polishing apparatus of claim 17, wherein the plurality of carrier heads are independently movable along the track.

19. The polishing apparatus of claim 17, wherein the track is circular.

* * * * *